US006244248B1

(12) United States Patent
Halleron et al.

(10) Patent No.: US 6,244,248 B1
(45) Date of Patent: Jun. 12, 2001

(54) VERIFYING ENGINE CYCLE OF AN INJECTION IC ENGINE

(75) Inventors: Ian Halleron; Michael Robert Garrard, both of Chelmsford (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/410,573

(22) Filed: Oct. 1, 1999

(30) Foreign Application Priority Data

Oct. 3, 1998 (GB) ..... 9821508

(51) Int. Cl.[7] ..... F02D 9/08
(52) U.S. Cl. ..... 123/339.12; 73/119 A
(58) Field of Search ..... 123/480, 339.12; 73/117.3, 119 A, 116, 117.2

(56) References Cited

U.S. PATENT DOCUMENTS 4,235,101 * 11/1980 Stadelmann ..... 73/116
4,407,155 * 10/1983 Sundeen ..... 73/116
4,561,056 * 12/1985 Hirayama et al. ..... 364/431.05
5,321,979 * 6/1994 McKendry et al. ..... 73/117.3
5,425,340 6/1995 Petitbon et al. ..... 123/436
5,572,973 * 11/1996 Schenk ..... 123/479
5,604,304 * 2/1997 Kokubo et al. ..... 73/117.3
5,613,473 3/1997 Angermaier ..... 123/481
5,699,769 * 12/1997 Uchinami et al. ..... 123/479
5,970,784 * 10/1999 Genin ..... 73/117.3

* cited by examiner

*Primary Examiner*—Henry C. Yuen
*Assistant Examiner*—Mahmoud Gimie
(74) *Attorney, Agent, or Firm*—Mark L. Mollon

(57) ABSTRACT

The present invention relates to verifying the cycle of a fuel injection internal combustion engine during running of the engine. The engine comprises a number of cylinders with pistons linked to a crankshaft, an exhaust conduit, one or more engine operating condition sensors including an exhaust gas sensor in an exhaust conduit, and an engine management system that includes timer means and fueling means for controlling the air/fuel ratio for at least one cylinder, the engine management system being arranged to receive from said sensors respective signals representative of engine operating conditions including exhaust gas condition, wherein the engine management system is capable of verifying the engine cycle by first altering the air/fuel ratio for one cylinder relative to the other cylinders, then timing a time delay until a signal is received from the exhaust gas sensor indicating a change in exhaust gas condition attributable to exhaust from said one cylinder and then comparing this delay against an expected delay according to the engine operating conditions.

10 Claims, 2 Drawing Sheets

VERIFYING ENGINE CYCLE OF AN INJECTION IC ENGINE

TECHNICAL FIELD

The present invention relates to verifying the cycle of a fuel injection internal combustion engine during running of the engine.

BACKGROUND ART

When a fuel injection internal combustion engine is started, it is desirable to supply fuel and, for a gasoline engine, sparks to each cylinder in turn at the correct time in order to optimise performance and engine emissions. There are two common ways of determining the state of the engine cycle, either with a single sensor detecting the rotational position of the camshaft, or with a pair of sensors, one on the camshaft and the other on the crankshaft. The single sensor on the camshaft is relatively expensive, and also has to be timed in to provide the required accuracy. The alternative approach uses cheaper sensors that do not have to be timed in, but the provision of two sensors adds manufacturing cost.

Ideally, it would be desirable to use just one sensor, which does not need to be timed in: that is, a crankshaft sensor alone. The crankshaft sensor gives an accurate signal according to the angular position of the crankshaft, but in a four-stroke engine cannot unambiguously determine engine cycle. For example, in a four-cylinder engine, the crank signal cannot discriminate between cylinder pairs 1 and 4, or 2 and 3.

Patent documents U.S. Pat. No. 5,425,340 and U.S. Pat. No. 5,613,473 disclose ways of addressing the problem of determining engine cycle when there is just a crankshaft sensor. In both of these disclosures, an engine management system purposely causes a misfire on one or more cylinders. This causes a drop in engine power immediately following the misfire, and a consequent small drop in engine speed, which can be detected from the crankshaft signal. Although this approach is effective in determining engine cycle, the misfiring is noticeable to the driver, who will interpret such misfires upon start up of the engine as an engine fault.

Furthermore, such misfires adversely affect the emissions performance of a motor vehicle engine. Although such misfires during cranking of the engine may not affect rated emissions performance in the case where this performance is measured during steady running of the engine, such misfires will affect the rated performance for stricter regulations including the period from when an engine is first started.

DISCLOSURE OF INVENTION

It is an object of the present invention to provide a more convenient way of synchronizing an internal combustion engine upon startup of the engine.

According to the invention, there is provided a four-stoke fuel injection internal combustion engine, comprising a number of cylinders with pistons linked to a crankshaft, an exhaust conduit, one or more engine operating condition sensors including an exhaust gas sensor in an exhaust conduit, and an engine management system that includes timer means and fueling means for controlling the air/fuel ratio for at least one cylinder, the engine management system being arranged to receive from the sensors respective signals representative of engine operating conditions including exhaust gas condition, wherein the engine management system is capable of verifying the engine cycle by first altering the air/fuel ratio for one cylinder relative to the other cylinders, then timing a time delay until a signal is received from the exhaust gas sensor indicating a change in exhaust gas condition attributable to exhaust from the one cylinder and then comparing this delay against an expected delay according to the engine operating conditions.

Also according to the invention, there is provided a method of verifying the engine cycle of a four-stroke fuel injection internal combustion engine, the engine comprising a number of cylinders with pistons linked to a crankshaft, an exhaust conduit, one or more engine operating condition sensors including an exhaust gas sensor in the exhaust conduit, and an engine management system that includes timer means and fueling means for controlling the air/fuel ratio for at least one cylinder, the engine management system being arranged to receive from the sensors respective signals representative of engine operating conditions including exhaust gas condition, wherein the method comprises the steps of:

a) altering the air/fuel ratio for one cylinder relative to the other cylinders;

b) using the timer means to time a time delay until a signal is received from the exhaust gas sensor indicating a change in exhaust gas condition attributable to exhaust from the one cylinder;

d) comparing this delay against an expected delay according to the engine speed in order to verify the engine cycle.

The expected time delay will have several components: for example an injection delay and/or induction delay, a combustion delay, an exhaust gas transport delay depending of the gas flow from the cylinder exhaust port to the sensor, and a sensor response delay.

If the engine cycle is thereby verified, then the engine management system can return the air/fuel mixture of the one cylinder to the original condition. In the case of an engine which has been warmed up and which is operating under normal load condition, such operation is usually sub-stoichiometric, i.e., slightly lean, with $\lambda=0.99$. Therefore, in most cases, the change in air/fuel mixture will be to a rich composition, for example with $\lambda=1.01$.

If the engine cycle is not verified, then the engine management system changes the timing of fuel injection events preferably just for the one cylinder by one full cycle of the engine, i.e., by a full 360° of crankshaft rotation. If the engine management system changes the engine cycle for all cylinders, then preferably this is phased over a few engine cycles in order to minimize any engine roughness perceived by the driver. The engine management system then performs again the steps of verifying the engine cycle for the one cylinder. When the engine cycle is verified, if necessary the engine cycle for the other cylinders is corrected, and again preferably in a phased manner so that not all cylinders change cycle at the same time.

In a preferred embodiment of the invention, the exhaust sensor is an exhaust gas oxygen sensor capable of indicating a change in exhaust gas oxygen level attributable to exhaust from the one cylinder. Alternatively, another sensor could be used, for example an exhaust gas temperature sensor.

The delay component for the time taken for exhaust gas to travel to the exhaust sensor will depend on a number of factors, including exhaust gas temperature, the volume and pressure of air drawn into all the cylinders, the amount of fuel supplied to all the cylinders, and the engine speed.

One sensor may, therefore, be an engine speed sensor, wherein the delay is compared against an expected delay according to engine speed. Such a sensor may be in proximity with a toothed flywheel on the engine crankshaft to sense movement of the teeth as the flywheel rotates. The sensor may then be arranged to supply to the engine management system with a series of pulses on each revolution of the crankshaft.

If the engine is a gasoline engine with a throttle for the cylinders, means may be provided by which the throttle position is known to the engine management system. The delay can then be compared against an expected delay according to throttle position.

The means by which the throttle position is known may be a sensor that senses movement in the throttle. However, the throttle may be controlled directly by the engine management system, in which case there may be no need to sense independently the movement of the throttle.

Altering the air/fuel mixture may have some small affect on engine power output. Optionally, therefore, the engine management system alters the timing of fuel injection events for the one cylinder in order to balance the power output of the cylinder relative to the other cylinders.

Similarly, when the engine is a spark ignition engine, the engine management system may alter the timing of spark events for the one cylinder in order to balance the power output of the cylinder relative to the other cylinders.

The engine management system will generally comprise a microprocessor running software that performs a range of engine management functions. Such software may encode an algorithm that allows the microprocessor to deduce an expected delay according to engine operating parameters. Alternatively, the engine management system may comprise a nonvolatile memory, for example, a read only memory (ROM), electrically programmable read only memory (EPROM), or a flash memory, that contains a lookup table of expected delays according to engine operating conditions.

BRIEF DESCRIPTION OF DRAWINGS

The invention will now be described in further detail by way of example, with reference to the accompanying drawings, in which.

BEST MODE FOR CARRYING OUT THE INVENTION

Figure 1A:
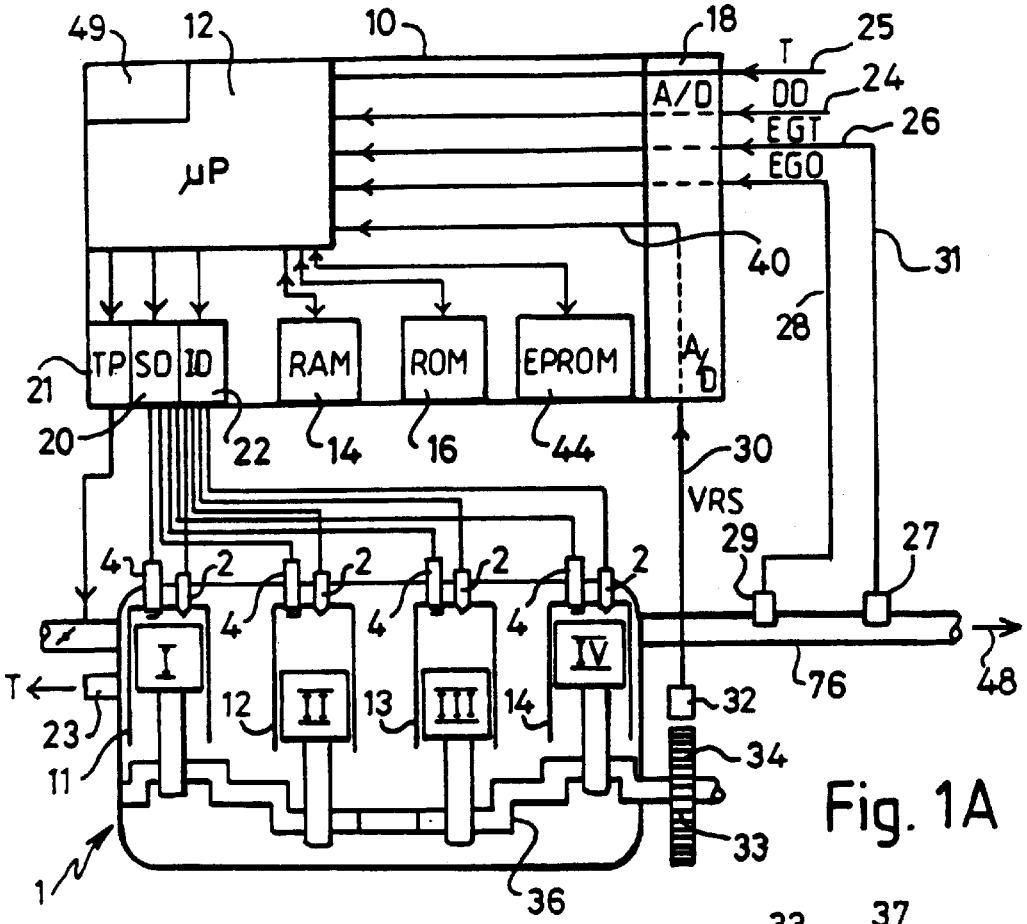
FIGS. 1A and 1B are schematic drawings of a four-cylinder fuel injection internal combustion engine according to the invention, with an engine management system that receives an exhaust gas condition signal and an engine speed signal from a sensor that detects the passage of teeth on a crankshaft flywheel.

FIG. 1A shows schematically a four-cylinder, four-stroke internal combustion engine 1, having an indirect injection device by which each of four cylinders 11,12,13,14 is supplied with fuel by an electro-injector 2. In this example, the engine 1 is a gasoline engine, and so is also equipped with spark plugs 4. The invention is, however, equally applicable to diesel engines, and to engines having a lesser or greater number of cylinders.

The opening sequence and timing of each electro-injector 2 and spark plug 4 is controlled by an electronic engine management system 10, which determines the amount of fuel and timing of fuel and spark events depending on engine operating conditions.

This engine control system 10 receives input signals, performs operations and generates output control signals, particularly for the fuel injectors 2 and spark plugs 4. The electronic engine management system 10 conventionally comprises a microprocessor ($\mu$P) 12, a random access memory (RAM) 14, a read only memory (ROM) 16, an analog-to-digital converter (A/D) 18 and various input and output interfaces, including a spark plug driver 20, a throttle control 21, and an injector driver 22.

The input signals comprise a driver demand signal (DD) 24, an engine temperature signal (T) 25 from an engine temperature sensor 23, an exhaust gas temperature signal (EGT) 26 from an exhaust temperature sensor 27, an exhaust gas oxygen signal (EGO) 28 from an exhaust gas oxygen sensor 29, and a signal 30 from a variable reluctance sensor (VRS) 32, all of which are digitized by the A/D converter 18 prior to being passed to the microprocessor 12.

Figure 1B:
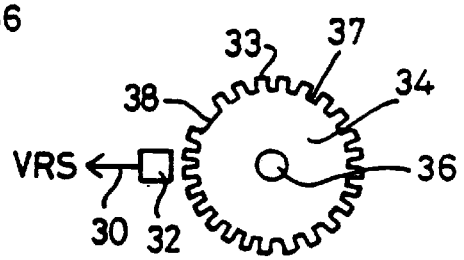

FIGS. 1A and 1B show how the variable reluctance sensor 32 senses the passage of teeth 33 spaced circumferentially around the periphery of a flywheel 34 on an engine crankshaft 36. The flywheel 34 has a conventional arrangement of teeth referred to herein as 36-1 teeth, wherein thirty-five identical teeth 33 are equally spaced by thirty-four gaps 37 between teeth, and with one pair of teeth being spaced by a larger gap 38 three times as large as the other gaps 37. The larger gap 38 corresponds to one missing tooth. The VRS signal 30 therefore comprises a series of essentially sinusoidal pulses for each revolution of the crankshaft, with one missing pulse. Digitization of the raw VRS signal 30 by the A/D converter 18 yields a digitized VRS signal, comprising a series of essentially square waves, with one missing pulse corresponding to the missing pulse 38 in the raw VRS signal 30.

The existence of the missing tooth allows the identification of a Top Dead Centre (TDC) position for the engine 1. For example, the falling edge of the last digitized pulse before the gap 38 may be at 90° before TDC. Conventionally, for a four-cylinder four-stroke engine having four corresponding pistons I,II,III,IV, the TDC position for the engine is also the TDC position of pistons I and IV, during one cycle of the engine, and TDC position of pistons II and III during the next cycle of the engine. FIG. 1 shows pistons I and IV at the top dead centre position.

It should be noted that in the example shown of an in-line, four-cylinder, four-stroke engine, exhibiting a firing order according to the sequence 1-3-4-2, pistons I and IV (or II and III) pass simultaneously to the TDC position, but with different phases, one then being in the intake (or compression) phase, and the other being in the power (or exhaust) phase. Each piston passes through two cycles, each consisting of 360° of angle, during the four phases or stokes of the cylinder during the intake/compression and power/exhaust phases. The flywheel 34 turns through an angle of 720° during the two cycles, and the variable reluctance sensor 32 produces two pulses indicating a TDC position of the engine 1. It is, therefore, not possible from the VRS signal 30 alone to determine which of the two cycles a cylinder is in, even though the VRS signal gives a good measure of angle after one revolution of the flywheel 34.

Figure 3:
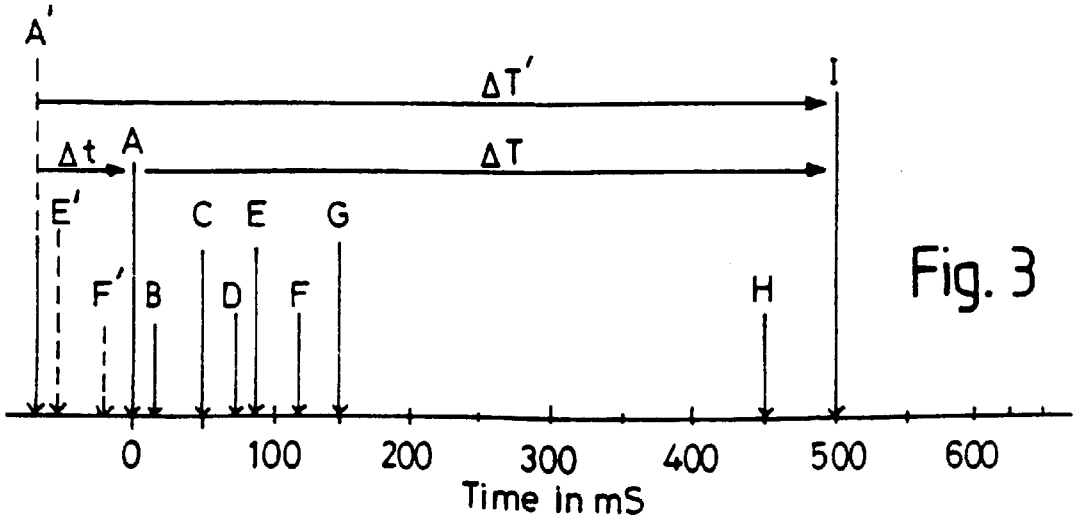
FIG. 3 is a plot of events during cycles of the engine and the time delay until a signal is output from an exhaust gas sensor.
Figure 2:
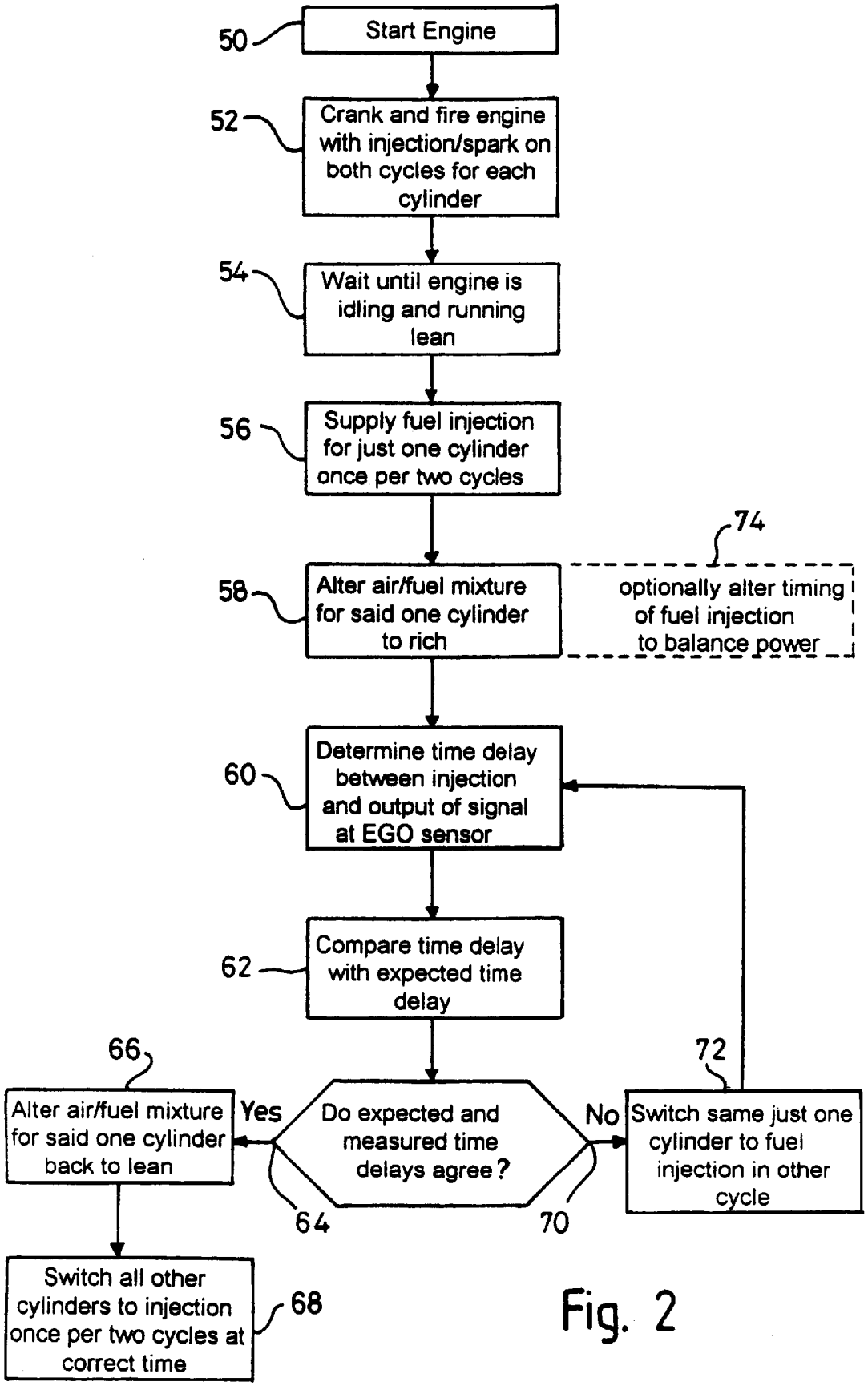
FIG. 2 is a flow diagram describing the control of the engine by the engine management system.

Once the engine cycle is known, however, it is in principle possible to keep track of the engine cycle by counting the series of pulses in the VRS signal 30. With reference now also to FIGS. 2 and 3, the engine management system 10 therefore comprises means to determine the engine cycle during running of the engine.

FIG. 2 shows a flow diagram of operation of the engine management system 10 and engine control software running in the microprocessor 12. When an engine is to be started, the engine management system 12 has no record of the engine's resting cycle or angle. When the driver turns the ignition key (not illustrated), the microprocessor receives a driver demand signal 24 instructing the microprocessor 12 to begin a sequence of operations 50 to start the engine 1. The microprocessor initiates 52 crank and firing of the engine 1 with fuel injection and spark events scheduled on each cycle of the engine for all cylinders 11–14, so that each cylinder receives two fuel injection commands and two spark events during the two cycles that consist of the four phases or strokes. The fuel/air mixture is also set initially to rich, with $\lambda$=1.01.

The engine management system 10 then waits 54 until the engine has warmed up and is running lean ($\lambda$=0.99) at an idling speed of the order of 1000 rpm. During the period when all cylinders are supplied with fuel and spark events on every cycle, the engine performance will be essentially unaffected, although emissions performance will not be optimal.

The engine management system then initiates 56 a procedure whereby the engine cycle is determined, so that each cylinder 11–14 can be supplied just once per two cycles with fuel and a spark event at the correct engine angles.

First, the fuel for just one of the cylinders 11–14 (it matters not which one) is supplied 56 on just one cycle, with no fuel being supplied on the other cycle. At the same time, the air/fuel mixture is set 58 to rich ($\lambda$=1.01).

FIG. 3 shows time lines for two possible sequences of events in the case of an indirect injection engine. If the fuel injection is correctly synchronized with the engine cycle, the fuel injection happens at point A, followed by the opening of an inlet valve (not shown) at point B, at the start of the induction stroke. The compression stroke starts at point C, followed by ignition at point D about 10° before TDC. The power stroke starts at point E followed by opening of the outlet valve (not shown) at point F and the start of the exhaust stroke. The exhaust valve closes at point G at which time all exhaust gasses 48 from that cylinder have entered an exhaust conduit 68.

At an engine speed of 1000 rpm, the time between the correctly scheduled injection event at A and point B is about 5 ms and the time between points A and G is about 60 ms.

There then follows a time delay which is typically longer, depending on the distance and volume of exhaust gas between the outlet valve and the exhaust gas oxygen sensor 29. In the present example, this time delay is about 300 ms. Commercially available exhaust gas oxygen sensors have a relatively rapid response time, of the order of about 50 ms in response to the change in exhaust oxygen levels between lean and rich operation. In the time before the exhaust gas from the one cylinder reaches the EGO sensor 29, the exhaust stream has higher oxygen content. The engine management system 10 registers the drop in oxygen content from the one rich-running cylinder, and can therefore determine the total delay $\Delta T$ according to suitable timer means, such as an onboard crystal oscillator 49.

The second time line is for the case of an incorrectly scheduled fuel injection event for the one cylinder. Here, primed letters, namely A', E', F' and T' refer to engine events that corresponding to engine events labelled with the same unprimed letters introduced above. An incorrectly scheduled fuel injection event therefore takes place at A', just before the power stroke E'. After the exhaust stroke F' is finished, the fuel is drawn into the cylinder at B as described above. There is therefore an additional delay $\Delta t$, so that the total delay $\Delta T'$ is greater than the delay $\Delta T$ for the correctly scheduled fuel injection event. The additional time $\Delta t$ amounts to about 30 ms at an engine speed of 1000 rpm, and this can readily be distinguished with the time resolution limit set by the EGO sensor 29 response time.

Returning now to consider the rest of FIG. 2, once the time delay $\Delta T$ or $\Delta T'$ is determined 60, the microprocessor 12 recalls data from a lookup table in the EPROM 44, which may have been loaded with calibrated data during manufacture of the engine. The microprocessor 12 then compares 62 the expected and measured time delays. If there is agreement 64, then the microprocessor 12 alters 66 the air/fuel mixture for the one cylinder back to lean and supplies 68 the remaining cylinders 11–14 with fuel and spark events just once every two engine cycles at the correct engine angles. To aid a smooth transition and avoid engine roughness, each remaining cylinder may be switched over one at a time.

If there is no agreement 70, then the microprocessor 12 switches 72 the one cylinder over to the other cycle, and then performs the same time delay measurement 60 and time delay comparison 62 described above, until agreement is reached. If no agreement can be reached, say after 10 passes through the loop defined by steps 60,62,70 and 72, then the engine management system may cease testing and set a flag (not shown) in a nonvolatile memory regarding this problem so that this can be addressed during the next servicing of the vehicle.

The switch from lean to rich operation for one cylinder will in general cause a nearly imperceptible change in engine smoothness. Optionally 74, during the testing for correct engine cycle, the engine management system may adjust the timing of spark events or fuel injection quantity of one or more cylinders to balance cylinder power and thereby smooth engine operation.

The apparatus and method according to the invention thereby permit the engine cycle to be determined in normal operation of the engine within the space of a few seconds and without the need to cause intentional misfires of a cylinder.

Compared with systems that need to cause an intentional misfire, the invention also permits an improvement in engine smoothness during the determination of correct engine cycle.

Since engines usually comprise EGO sensors for control of exhaust emission, and because known engine management systems are typically equipped with microprocessors in order to handle complex computational and control operations, the changes or additions to be made to carry out the described method of synchronization can be attained essentially by changes and additions to the existing microprocessor programs.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A four-stroke fuel injection internal combustion engine comprising:

a plurality of cylinders with pistons linked to a crankshaft, an exhaust conduit, at least one engine operating condition sensor and an exhaust gas sensor in an exhaust conduit, and an engine management system that includes a timer and fueling controller for controlling the air/fuel ratio for at least one cylinder, the engine management system being arranged to receive from the at least one sensor respective signals representative of engine operating conditions including exhaust gas condition, wherein the engine management system further comprises a processor arranged to verify the engine cycle by first altering the air/fuel ratio for one cylinder relative to the other cylinders, then timing a time delay until a signal is received from the exhaust gas sensor indicating a change in exhaust gas condition attributable to exhaust from the one cylinder, and then comparing this delay against an expected delay according to the engine operating conditions.

2. An engine as claimed in claim 1, in which the exhaust sensor comprises an exhaust gas oxygen sensor capable of indicating a change in exhaust gas oxygen level attributable to exhaust from said one cylinder.

3. An engine as claimed in claim 1 wherein the at least one sensor comprises an engine speed sensor, wherein the processor is arranged to compare the delay against an expected delay according to engine speed.

4. An engine as claimed in claim 3, in which the engine has a toothed flywheel on the crankshaft, wherein the speed sensor is arranged in proximity with the flywheel to sense movement of the teeth as the flywheel rotates in order to provide to the engine management system a series of pulses on each revolution of the crankshaft.

5. An engine as claimed in claim 1, in which the engine is a gasoline engine with a throttle for the cylinders, wherein the processor is coupled to a throttle position sensing arrangement so that the throttle position is known to the engine management system, wherein the delay is compared against an expected delay according to throttle position.

6. An engine as claimed in claim 1, in which the processor is arranged to alter the timing of fuel injection events for the one cylinder in order to balance the power output of the cylinder relative to the other cylinders.

7. An engine as claimed in claim 1, in which the engine is a spark ignition engine, wherein the processor is arranged to alter the timing of spark events for the one cylinder in order to balance the power output of the cylinder relative to the other cylinders.

8. An engine as claimed in claim 1, in which the engine management system comprises a nonvolatile memory that contains a lookup table of expected delays according to engine operating conditions.

9. A method of verifying the engine cycle of a four-stroke, fuel-injection, internal-combustion engine, the engine comprising a plurality of cylinders with pistons linked to a crankshaft, an exhaust conduit, at least one engine operating condition sensor and an exhaust gas sensor in the exhaust conduit, and an engine management system that includes a timer and fueling controller for controlling the air/fuel ratio for at least one cylinder, the engine management system being arranged to receive from said sensors respective signals representative of engine operating conditions including exhaust gas condition, wherein the method comprises:

a) altering the air/fuel ratio for one cylinder relative to the other cylinders;

b) using the timer to time a time delay until a signal is received from the exhaust gas sensor indicating a change in exhaust gas condition attributable to exhaust from the one cylinder; and d) comparing this delay against an expected delay according to the engine operating conditions in order to verify the engine cycle.

10. A method as claimed in claim 9, in which in the case that engine cycle is not verified in step d) as being correct, the method further comprises:

e) changing the timing of fuel injection events preferably just for one cylinder by one full cycle of the engine;

f) repeating steps a) to d); and g) when the engine cycle is verified, determining whether to correct the engine cycle for the other cylinders.

* * * * *